US011482180B2

(12) United States Patent
Min et al.

(10) Patent No.: US 11,482,180 B2
(45) Date of Patent: Oct. 25, 2022

(54) DEVICE AND METHOD FOR MEASURING ORGANIC LIGHT EMITTING DIODE

(71) Applicant: SILICON WORKS CO., LTD., Daejeon (KR)

(72) Inventors: Kyung Jik Min, Daejeon (KR); Jeong Hoon Choi, Gimpo-si (KR); Dong Ju Kim, Siheung-si (KR); Jung Bae Yun, Daejeon (KR)

(73) Assignee: Silicon Works Co., Ltd., Daejeon (KR)

( * ) Notice: Subject to any disclaimer, the term of this patent is extended or adjusted under 35 U.S.C. 154(b) by 245 days.

(21) Appl. No.: 16/493,259

(22) PCT Filed: Feb. 7, 2018

(86) PCT No.: PCT/KR2018/001655

§ 371 (c)(1),
(2) Date: Sep. 11, 2019

(87) PCT Pub. No.: WO2018/169212

PCT Pub. Date: Sep. 20, 2018

(65) Prior Publication Data

US 2020/0135072 A1 Apr. 30, 2020

(30) Foreign Application Priority Data

Mar. 14, 2017 (KR) ..... 10-2017-0031602

(51) Int. Cl.
*G09G 3/32* (2016.01)
*G09G 3/3291* (2016.01)
(Continued)

(52) U.S. Cl.
CPC ..... *G09G 3/3291* (2013.01); *G09G 3/006* (2013.01); *G09G 3/3233* (2013.01);
(Continued)

(58) Field of Classification Search
CPC .... G09G 3/3291; G09G 3/006; G09G 3/3233; G09G 3/3258; G09G 2320/046;
(Continued)

(56) References Cited

U.S. PATENT DOCUMENTS 7,245,277 B2 * 7/2007 Ishizuka ..... G09G 3/3233 345/82
9,311,859 B2 * 4/2016 Chaji ..... G09G 3/3291
(Continued)

FOREIGN PATENT DOCUMENTS

CN 104658474 A 5/2015
CN 10470072 A 6/2015
(Continued)

OTHER PUBLICATIONS

International Search Report and Written Opinion; PCT No. PCT/KR2018/001655; dated Jun. 18, 2018.
(Continued)

*Primary Examiner* — Jose R Soto Lopez
(74) *Attorney, Agent, or Firm* — Polsinelli PC

(57) ABSTRACT

Disclosed are a device and method for measuring an organic light emitting diode, which measures an amount of energy for compensating for a burn-in of an organic light emitting diode, by sensing a charged voltage of a sensing line connected to the organic light emitting diode. The device for measuring an organic light emitting diode includes an external current source, and is configured to measure an amount of energy for compensating for a burn-in, by sensing a charged voltage of a parasitic capacitor of a sensing line.

9 Claims, 2 Drawing Sheets

(51) Int. Cl.
*G09G 3/00* (2006.01)
*G09G 3/3233* (2016.01)
*G09G 3/3258* (2016.01)

(52) U.S. Cl.
CPC ..... *G09G 3/3258* (2013.01); *G09G 2320/046* (2013.01); *G09G 2330/12* (2013.01)

(58) Field of Classification Search
CPC ..... G09G 2330/12; G09G 2320/0295; G09G 2320/0257
See application file for complete search history.

(56) References Cited

U.S. PATENT DOCUMENTS 10,657,895 B2 * 5/2020 Chaji ..... G09G 3/006
2007/0139311 A1 * 6/2007 Cho ..... G09G 3/3233 345/76
2008/0088648 A1 * 4/2008 Nathan ..... H05B 45/60 345/76
2008/0122759 A1 * 5/2008 Levey ..... G09G 3/3233 345/78
2008/0122760 A1 * 5/2008 Levey ..... G09G 3/3233 345/78
2008/0315788 A1 * 12/2008 Levey ..... G09G 3/3233 315/291
2009/0051628 A1 2/2009 Kwon
2009/0213046 A1 * 8/2009 Nam ..... G09G 3/3233 345/76
2010/0103159 A1 * 4/2010 Leon ..... G09G 3/3233 345/212
2010/0156766 A1 * 6/2010 Levey ..... G09G 3/3233 345/78
2010/0188390 A1 * 7/2010 Min ..... G09G 3/3291 345/82
2010/0245331 A1 9/2010 Shirouzu et al.
2011/0007067 A1 1/2011 Ryu et al.
2011/0109605 A1 * 5/2011 Omori ..... G09G 3/3648 345/207
2011/0279436 A1 * 11/2011 Komiya ..... G09G 3/3233 345/212
2012/0169704 A1 * 7/2012 Chung ..... G09G 3/3233 345/212
2012/0299978 A1 * 11/2012 Chaji ..... G09G 3/006 345/690
2014/0368489 A1 12/2014 Pak
2015/0062199 A1 3/2015 Ryu et al.
2015/0154908 A1 * 6/2015 Nam ..... G09G 3/3233 345/76
2015/0379909 A1 * 12/2015 Yu ..... G09G 3/006 345/78
2015/0379937 A1 * 12/2015 Kim ..... G09G 3/3275 345/691
2016/0012798 A1 * 1/2016 Oh ..... G09G 3/3283 345/82
2016/0071445 A1 * 3/2016 Kim ..... G09G 3/3291 345/212
2016/0086544 A1 * 3/2016 Park ..... G09G 3/3233 345/82
2016/0155377 A1 * 6/2016 Kishi ..... G09G 3/3233 345/214
2016/0189625 A1 6/2016 Kim et al.
2016/0321991 A1 * 11/2016 Song ..... H01L 51/5209
2017/0004764 A1 * 1/2017 Kim ..... G09G 3/3233
2017/0154573 A1 * 6/2017 Woo ..... G09G 3/3233
2017/0193918 A1 * 7/2017 Bae ..... G09G 3/3291
2017/0289805 A1 * 10/2017 Hong ..... G09G 3/3233
2018/0005579 A1 * 1/2018 Brahma ..... G09G 3/3258
2018/0033366 A1 * 2/2018 Yoo ..... G09G 3/2003
2018/0040276 A1 * 2/2018 Cronin ..... H05B 45/345
2018/0053462 A1 * 2/2018 Bae ..... G09G 3/2074
2018/0144705 A1 * 5/2018 Lee ..... G09G 3/3685
2018/0166515 A1 * 6/2018 An ..... G09G 3/3291
2018/0182288 A1 * 6/2018 Kim ..... H01L 27/3244
2019/0139492 A1 * 5/2019 Chen ..... G09G 3/3266

FOREIGN PATENT DOCUMENTS

CN 105096820 A 11/2015
CN 105321456 A 2/2016
KR 20090057484 A 6/2009
KR 20110005500 A 1/2011
KR 2012-0079364 A 7/2012
KR 20140083144 A 7/2014
KR 2015-0074657 A 7/2015
KR 20150078724 A 7/2015
KR 101581593 B1 12/2015
KR 20160007971 A 1/2016
KR 20160092593 A 8/2016
KR 20160094130 A 8/2016
KR 20160141266 A 12/2016
KR 20170080360 A 7/2017

OTHER PUBLICATIONS

Translated International Report and Written Opinion for PCT No. PCT/KR2018/001655.
English abstract of KR20160094130; retrieved from www.espacenet.com on Sep. 10, 2019.
English abstract of KR20170083144; retrieved from www.espacenet.com on Sep. 10, 2019.
English abstract of KR20170080360; retrieved from www.espacenet.com on Sep. 10, 2019.
English abstract of KR20160141266; retrieved from www.espacenet.com on Sep. 10, 2019.
English abstract of KR20150078724; retrieved from www.espacenet.com on Sep. 10, 2019.
English abstract of KR20170007971; retrieved from www.espacenet.com on Sep. 10, 2019.
English abstract of KR20160092593; retrieved from www.espacenet.com on Sep. 10, 2019.
English abstract of KR101581593; retrieved from www.espacenet.com on Sep. 10, 2019.
English abstract of KR20090057484; retrieved from www.espacenet.com on Sep. 10, 2019.
English abstract of KR20110005500; retrieved from www.espacenet.com on Sep. 10, 2019.

* cited by examiner

DEVICE AND METHOD FOR MEASURING ORGANIC LIGHT EMITTING DIODE

TECHNICAL FIELD

Various embodiments generally relate to measurement of an organic light emitting diode, and more particularly, to a device and method for measuring an organic light emitting diode, which measures an amount of energy for compensating for a burn-in of an organic light emitting diode, by sensing a charged voltage of a sensing line connected to the organic light emitting diode.

BACKGROUND ART

An organic light emitting diode is a display device which emits light using an organic compound, and is used in configuration of a pixel of a flat panel display device.

An organic light emitting diode has a characteristic that the luminous efficiency thereof degrades as it is used for a long time. The degradation in luminous efficiency may cause a burn-in that occurs due to differences in luminous efficiency and luminance between the organic light emitting diode and surrounding organic light emitting diodes as a use time of the organic light emitting diode increases.

Organic light emitting diodes forming pixels of a flat panel display device have different lifetimes, and thus have differences in luminous efficiency with an increase in use time.

A burn-in means a phenomenon in which, because an organic light emitting diode does not sufficiently express the same luminance and color, the organic light emitting diode has differences in luminance and color from surrounding organic light emitting diodes and thereby a screen appears to be stained.

In order to compensate for the burn-in, more energy (voltage or current) should be supplied to the organic light emitting diode by the lowered luminous efficiency of the organic light emitting diode. Therefore, an amount of energy to be supplied to the organic light emitting diode needs to be measured to compensate for the burn-in.

DISCLOSURE

Technical Problem

Various embodiments are directed to a device and method for measuring an organic light emitting diode, which performs measurement of an amount of energy necessary to compensate for a burn-in and driving control of an organic light emitting diode for the measurement, by using one scan line.

Also, various embodiments are directed to a device and method for measuring an organic light emitting diode, capable of measuring an amount of energy necessary to compensate for a burn-in, by using an external current source.

Further, various embodiments are directed to a device and method for measuring an organic light emitting diode, capable of being realized at a low cost by connecting a parasitic capacitor of a sensing line to an organic light emitting diode, charging the parasitic capacitor and sensing a charged voltage of the parasitic capacitor.

In addition, various embodiments are directed to a device and method for measuring an organic light emitting diode, capable of sensing a deviation in capacitances of parasitic capacitors of sensing lines for measuring amounts of energy for compensating for burn-ins of pixels corresponding to one driver or pixels corresponding to different drivers or a deviation in amounts of constant current of current sources.

Technical Solution

In an embodiment, a device for measuring an organic light emitting diode may include: a sensing line formed with a parasitic capacitor; a first switch configured to switch connection between the organic light emitting diode and the sensing line; a current source configured to provide current to the sensing line; and a sensing circuit configured to sense a charged voltage of the parasitic capacitor, wherein the current source charges the parasitic capacitor by supplying the current to the sensing line for a first period, in a state in which the organic light emitting diode is extinguished and the first switch is turned on, and wherein the sensing circuit senses the charged voltage of the parasitic capacitor after the first period.

In an embodiment, a method for measuring an organic light emitting diode may include: connecting a turned-off organic light emitting diode to a sensing line; applying a precharge voltage to the sensing line to charge a parasitic capacitor of the sensing line to a level of the precharge voltage; providing constant current to the sensing line for a predetermined period to charge the parasitic capacitor charged to the precharge voltage; and sensing a charged voltage of the parasitic capacitor by using a sensing circuit.

In an embodiment, a device for measuring an organic light emitting diode may include: a first sensing line selectively connected with a first organic light emitting diode, and formed with a first parasitic capacitor; a second sensing line selectively connected with a second organic light emitting diode, and formed with a second parasitic capacitor; a compensation capacitor; and a switching circuit configured to sequentially connect the first sensing line and the second sensing line to the compensation capacitor, wherein deviation information is generated based on a first charge share voltage by connection of the first sensing line and the compensation capacitor and a second charge share voltage by connection of the second sensing line and the compensation capacitor.

Advantageous Effects

According to the embodiments of the disclosure, it is possible to control measurement of an amount of energy necessary to compensate for a burn-in and switching of a driving transistor which drives an organic light emitting diode, by using a scan signal of one scan line, whereby the number of scan lines configured in a display panel may be reduced.

If the number of scan lines is reduced, the configuration of a device for measuring an amount of energy for compensating for a burn-in of an organic light emitting diode may be simplified, and the luminance of a pixel may be improved.

Further, according to the embodiments of the disclosure, an amount of energy necessary to compensate for a burn-in may be measured using an external current source. Therefore, since it is not necessary to use a driving transistor as a current source, a separate scan line for controlling the current source is not required. Thus, control of a driving transistor for measuring leakage current for compensating for a burn-in may be implemented using a scan signal of one scan line.

In addition, according to the embodiments of the disclosure, by sensing a charged voltage of a parasitic capacitor, sensing may be implemented regardless of a panel load, and a fast sensing speed may be obtained.

Moreover, according to the embodiments of the disclosure, it is possible to measure a deviation in capacitances of parasitic capacitors of sensing lines connected to pixels corresponding to one driver or different drivers or a deviation in amounts of constant current of current sources for charging the parasitic capacitors of the sensing lines.

MODE FOR DISCLOSURE

Figure 1:
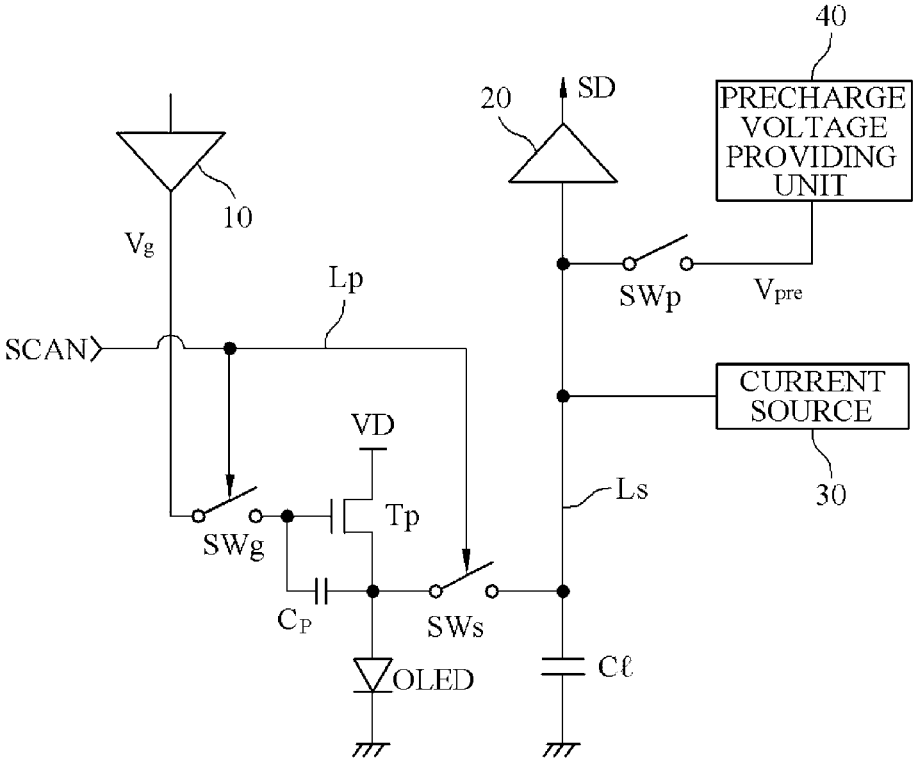
FIG. 1 is a circuit diagram illustrating a representation of an example of a device for measuring an organic light emitting diode in accordance with an embodiment of the disclosure.

Hereinafter, embodiments of the disclosure will be described in detail with reference to the accompanying drawings. The terms used herein and in the claims shall not be construed by being limited to general or dictionary meanings and shall be interpreted based on the meanings and concepts corresponding to technical aspects of the disclosure.

Embodiments described herein and configurations illustrated in the drawings are preferred embodiments of the disclosure, and, because they do not represent all of the technical features of the disclosure, there may be various equivalents and modifications that can be made thereto at the time of the present application.

The disclosure discloses a method of measuring an amount of energy necessary to compensate for a burn-in of an organic light emitting diode, by measuring leakage current of the organic light emitting diode.

An organic light emitting diode degrades in luminous efficiency as a use time increases, and the degradation in the luminous efficiency occurs by leakage current of the organic light emitting diode. That is to say, if the luminous efficiency of an organic light emitting diode degrades, an amount of leakage current of the organic light emitting diode increases.

The disclosure measures an amount of leakage current of an organic light emitting diode by using one sensing line.

An amount of energy to be supplied to an organic light emitting diode to solve a burn-in may be calculated by measuring an amount of leakage current occurring in the organic light emitting diode.

An embodiment for measuring an amount of leakage current may be configured as illustrated in FIG. 1.

Referring to FIG. 1, a driving transistor Tp and an organic light emitting diode OLED are configured in series. The driving transistor Tp and the organic light emitting diode OLED are illustrated as configuring one pixel of a display panel (not illustrated), and the display panel has a number of pixels each including the driving transistor Tp and the organic light emitting diode OLED.

The organic light emitting diode OLED may be configured in such a manner that driving current provided through the driving transistor Tp is inputted to an input terminal thereof and an output terminal thereof is grounded.

The driving transistor Tp is configured in such a manner that a switch SWg is connected to a gate thereof, a constant voltage VD is applied to an input terminal thereof and the organic light emitting diode OLED is connected to an output terminal thereof. A capacitance may exist between the output terminal and the gate of the driving transistor Tp. The capacitance may be equivalently expressed as a capacitor Cp between the output terminal and the gate of the driving transistor Tp.

A switch SWs is configured between a node between the output terminal of the driving transistor Tp and the input terminal of the organic light emitting diode OLED and a sensing line Ls.

The switches SWg and SWs are switched by a scan signal SCAN which is provided through one scan line Lp.

The switch SWg is to switch transfer of a driving voltage Vg to be applied to the gate of the driving transistor Tp. The driving voltage Vg may be provided from a digital-analog converter 10 or an output buffer (not illustrated) configured outside the display panel. The digital-analog converter 10 or the output buffer may be mounted in an integrated circuit which serves as a driver.

The switch SWs is to connect the organic light emitting diode OLED to the sensing line Ls.

The sensing line Ls is configured to extend from the pixel to an outside of the display panel to sense a property of the organic light emitting diode OLED, and has a parasitic capacitance. A parasitic capacitor Cl of FIG. 1 is an equivalent expression of the parasitic capacitance of the sensing line Ls.

A sensing circuit which is configured outside the display panel may be connected to the sensing line Ls. The sensing circuit may be configured using an analog-digital converter 20, for example.

The analog-digital converter 20 as the sensing circuit senses a charged voltage of the parasitic capacitor Cl formed on the sensing line Ls, and outputs a digital signal SD corresponding to the charged voltage.

A current source 30 and a precharge voltage providing unit 40 may be connected to the sensing line Ls.

The precharge voltage providing unit 40 is configured as a constant voltage source for providing a precharge voltage Vpre to the sensing line Ls, and provides the precharge voltage Vpre to the sensing line Ls when a switch SWp is turned on.

The current source 30 is configured as a constant current source for providing constant current to the sensing line Ls.

The analog-digital converter 20, the current source 30 and the precharge voltage providing unit 40 may be configured outside the display panel, and may be configured in the driver which provides the driving voltage Vg or may be configured as an application processor which is configured separately from the driver.

Figure 2:
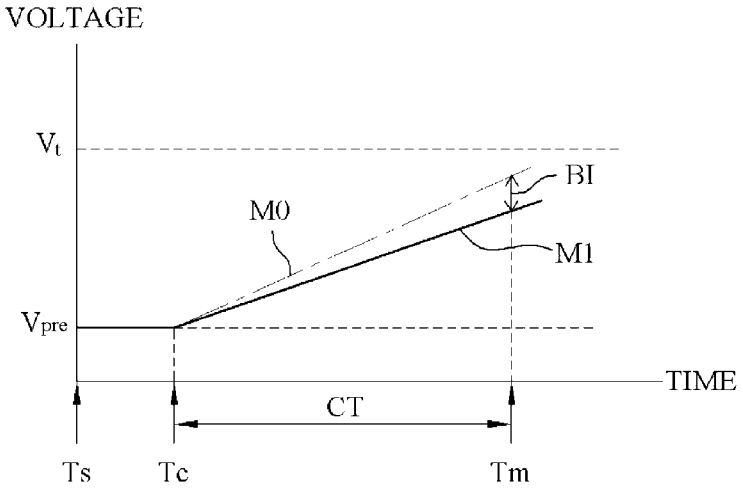
FIG. 2 is a representation of an example of a graph to assist in the explanation of the operation of the device illustrated in FIG. 1.

The operation of the embodiment of the disclosure configured as mentioned above with reference to FIG. 1 will be described below with reference to FIG. 2.

The embodiment of the disclosure performs leakage current sensing for compensating for a burn-in, in a state in which the organic light emitting diode OLED is extinguished.

At an initial time Ts for sensing, the driving transistor Tp is turned off to extinguish the organic light emitting diode OLED.

The switches SWg, SWs and SWp are turned on to turn-off the driving transistor Tp. The turn-on of the switches SWg and SWs is controlled by a level of the scan signal SCAN of the scan line Lp, and the turn-on of the switch SWp is controlled by a level of a control signal which is provided from a separate control unit (e.g., a timing controller).

The driving voltage Vg is applied to the gate through the turned-on switch SWg. The driving voltage Vg is provided to have a level to turn off the driving transistor Tp.

By the turn-on of the switch SWs, the node between the driving transistor Tp and the organic light emitting diode OLED is connected to the sensing line Ls.

By the turn-on of the switch SWp, the precharge voltage providing unit 40 is connected to the sensing line Ls.

By the above configuration, the precharge voltage providing unit 40 provides the precharge voltage Vpre to the sensing line Ls. Thus, the precharge voltage Vpre is applied to the output terminal of the driving transistor Tp through the switch SWs.

By the above-described voltage environment, the driving transistor Tp stably maintains the turn-off since a voltage formed between the gate and the output terminal, that is, a voltage applied to the capacitor Cp, is formed to be equal to or lower than a threshold voltage Vt.

By the above-described switching environment at the initial time Ts, the parasitic capacitor Cl of the sensing line Ls is charged to the level of the precharge voltage Vpre.

The above-described voltage environment at the initial time Ts is maintained until a charged voltage of the parasitic capacitor Cl reaches the precharge voltage Vpre.

After a charged voltage of the parasitic capacitor Cl reaches the precharge voltage Vpre, the parasitic capacitor Cl is charged using current of the current source 30 for a predetermined period CT from a preset time Tc. At this time, the switch SWp may be turned off.

A charged voltage of the parasitic capacitor Cl gradually rises from the precharge voltage Vpre during the predetermined period CT.

The current source 30 may be configured to provide constant current to the sensing line Ls.

The organic light emitting diode OLED provides a path through which leakage current occurs, by degradation.

Therefore, a portion of the current provided to the sensing line Ls from the current source 30 is consumed as leakage current. Thus, an amount of current used for charging the parasitic capacitor Cl is obtained by subtracting an amount of current consumed as leakage current from a total amount of current supplied to the sensing line Ls from the current source 30.

It may be assumed that leakage current does not occur before the organic light emitting diode OLED is degraded, and in this case, a charged voltage of the parasitic capacitor Cl may rise as indicated by the line M0 by current of the current source 30.

However, if leakage current occurs as the organic light emitting diode OLED is degraded, a charged voltage of the parasitic capacitor Cl may rise to a level lower than the line M0 as indicated by the line M1 in correspondence to an amount of leakage current.

A measurement time Tm may be determined after the predetermined period CT passes. The period CT for charging the parasitic capacitor Cl may be determined within a range capable of securing a valid sensing value (or data) when comparing a result of sensing a charged voltage of the parasitic capacitor Cl with that before the organic light emitting diode OLED is degraded.

The measurement time Tm may be determined in such a manner that a charged voltage of the parasitic capacitor Cl is within a voltage range in which the organic light emitting diode OLED is maintained in an extinguished state.

At the measurement time Tm, the analog-digital converter 20 as the sensing circuit senses a charged voltage of the parasitic capacitor Cl on the sensing line Ls, and outputs the digital signal SD corresponding to the charged voltage. The current source 30 may stop supply of constant current after the measurement time Tm, and the analog-digital converter 20 may be controlled to perform sensing after the supply of constant current of the current source 30 is stopped.

A charged voltage of the parasitic capacitor Cl at the measurement time Tm has a voltage difference BI of an amount corresponding to leakage current through the organic light emitting diode OLED as compared with before the organic light emitting diode OLED is degraded.

The charged voltage measured by the embodiment of the disclosure may be used in correcting display data for emitting the organic light emitting diode OLED. That is to say, the display data may be corrected in correspondence to the voltage difference BI, and the driving of the driving transistor Tp may be controlled in correspondence to the corrected display data. As a result, as driving current corresponding to the corrected display data is provided to the input terminal of the organic light emitting diode OLED, a burn-in by the degraded organic light emitting diode OLED may be solved.

The embodiment of the disclosure described above is configured such that the switches SWg and SWs are controlled using a scan signal provided through one scan line. In other words, it is not necessary to configure separate scan lines to the switches SWg and SWs, respectively. Therefore, the number of scan lines configured in the entire pixels of a display panel may be reduced.

As the number of scan lines is reduced, the configuration of the display panel may be simplified, and the luminance of a pixel may be improved.

Further, in the present disclosure, an amount of energy necessary to compensate for a burn-in may be measured using an external current source.

Thus, since a driving transistor need not be used as a current source for measurement of leakage current, control of the driving transistor for compensating for a burn-in may be simply implemented using a scan signal of one scan line.

Moreover, in the present disclosure, by sensing a charged voltage raised by charging a parasitic capacitor of a sensing line from a precharge voltage, an amount of energy necessary to compensate for a burn-in may be measured.

Therefore, a manufacturing cost may be reduced since a current measurement circuit is not needed, sensing may be implemented regardless of a panel load, and a fast sensing speed may be obtained.

Meanwhile, the present disclosure may be configured for pixels which are driven by the same driver or pixels which are driven by different drivers.

A parasitic capacitance which is formed in a sensing line corresponding to a pixel may be different for each pixel. Also, amounts of constant current outputted from current sources which are configured on sensing lines, respectively, may vary.

Thus, deviations in parasitic capacitances of sensing lines and amounts of current of current sources need to be compensated for.

Figure 3:
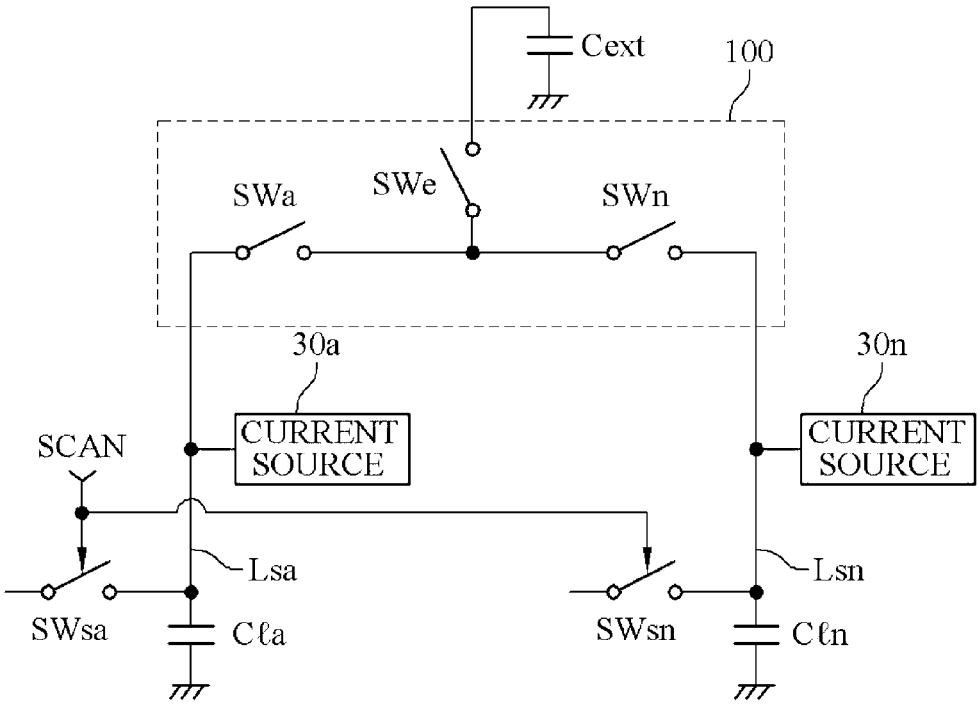
FIG. 3 is a circuit diagram illustrating a representation of an example of another embodiment of the disclosure.

The present disclosure may include a switching circuit 100 and a compensation capacitor Cext to compensate for a deviation in parasitic capacitance or amount of current, as illustrated in FIG. 3.

For the sake of convenience in explanation, the embodiment of FIG. 3 illustrates sensing lines Lsa and Lsn corresponding to two pixels and illustrates that switches SWsa and SWsn and current sources 30*a* and 30*n* are connected to the sensing lines Lsa and Lsn, respectively. In FIG. 3, since organic light emitting diodes and driving transistors connected to the sensing lines Lsa and Lsn, respectively, through the switches SWsa and SWsn and precharge voltage providing units connected to the sensing lines Lsa and Lsn, respectively, may be understood by referring to FIG. 1, repeated illustration and description therefor will be omitted herein.

The current sources 30*a* and 30*n* may be configured in correspondence to one driver, and the sensing lines Lsa and Lsn may be configured to be connected to the one driver. In this case, the driver may drive the organic light emitting diodes corresponding to the sensing lines Lsa and Lsn, by receiving data compensated for in correspondence to deviation information.

Unlike this, the current source 30*a* may be configured in correspondence to a first driver, and the current source 30*n* may be configured in correspondence to a second driver. In this case, the first driver and the second driver may drive the organic light emitting diodes corresponding to the sensing lines Lsa and Lsn, by receiving data compensated for in correspondence to respective deviation information.

The fact that each of the current sources 30*a* and 30*n* is configured in correspondence to a driver includes that each of the current sources 30*a* and 30*n* is configured inside the driver or is configured outside the driver.

The switching circuit 100 may be configured to include switches SWa and SWn which are connected to the sensing lines Lsa and Lsn, respectively, and a switch SWe for connecting the switches SWa and SWn to the compensation capacitor Cext. The switches SWa, SWn and SWe may be configured to be controlled in switching by control signals provided from a control circuit such as a timing controller (not illustrated).

First, in order to generate deviation information, the switch SWe of the switching circuit 100 maintains a turned-on state and thereby connects the compensation capacitor Cext to the switches SWa and SWn.

In order to generate deviation information, the switch SWa is turned on for a predetermined time and is then turned off, and thereafter, the switch SWn is turned on for a predetermined time and is then turned off.

Namely, the sensing line Lsa is connected to the compensation capacitor Cext during the predetermined time through the switches SWa and SWe, and thereafter, the sensing line Lsn is connected to the compensation capacitor Cext during the predetermined time through the switches SWn and SWe.

The compensation capacitor Cext may be configured to be reset to a preset voltage before it is connected with the sensing lines Lsa and Lsn.

In the case where the sensing line Lsa and the compensation capacitor Cext are connected, a charged voltage of a parasitic capacitor Cla of the sensing line Lsa is charge-shared by the compensation capacitor Cext. Therefore, the compensation capacitor Cext has a charge share voltage by the charged voltage of the parasitic capacitor Cla of the sensing line Lsa.

In the present embodiment of the disclosure, after the charge share voltage for the sensing line Lsa is stored, the sensing line Lsn and the compensation capacitor Cext are connected.

In the case where the sensing line Lsn and the compensation capacitor Cext are connected, a charged voltage of a parasitic capacitor Cln of the sensing line Lsn is charge-shared by the compensation capacitor Cext. Therefore, the compensation capacitor Cext has a charge share voltage by the charged voltage of the parasitic capacitor Cln of the sensing line Lsn.

In the present embodiment of the disclosure, after the charge share voltage for the sensing line Lsn is stored, deviation information is generated based on the charge share voltage by the parasitic capacitor Cla of the sensing line Lsa and the charge share voltage by the parasitic capacitor Cln of the sensing line Lsn.

The deviation information may be used in changing an amount of energy necessary to compensate for a burn-in measured by the embodiment of FIG. 1.

In the present disclosure, it is possible to measure a deviation in capacitances of parasitic capacitors of sensing lines connected to pixels corresponding to one driver or different drivers or a deviation in amounts of constant current of current sources for charging the parasitic capacitors of the sensing lines, and reflect the deviation on compensation of a burn-in.

While various embodiments have been described above, it will be understood to those skilled in the art that the embodiments described are by way of example only. Accordingly, the disclosure described herein should not be limited based on the described embodiments.

The invention claimed is:

1. A device for measuring an organic light emitting diode, comprising:

a sensing line formed with a parasitic capacitor;

a driving transistor configured to provide light emission current to the organic light emitting diode;

a first switch configured to switch connection between the organic light emitting diode and the sensing line by a scan signal provided through a scan line;

a third switch configured to switch application of the driving voltage to a gate of the driving transistor by the scan signal;

a current source configured to provide current to the sensing line for a first period; and a sensing circuit configured to sense a charged voltage of the parasitic capacitor, wherein the parasitic capacitor is precharged with a precharge voltage provided through the sensing line before the first period, in a state in which the organic light emitting diode is extinguished and the first switch and the third switch are turned on by the scan signal, wherein the current source charges the parasitic capacitor by supplying the current to the sensing line for the first period, and wherein the sensing circuit senses the charged voltage of the parasitic capacitor after the first period.

2. The device according to claim 1, further comprising:

a precharge voltage provider configured to provide the precharge voltage; and a second switch configured to be turned on to connect the precharge voltage provider to the sensing line before the first period.

3. The device according to claim 1, wherein the level of the precharge voltage and the charged voltage of the parasitic capacitor are determined within a voltage range in which the organic light emitting diode is maintained in an extinguished state.

4. The device according to claim 1, wherein the first and third switches are turned on by the scan signal before the first period, and wherein voltages applied to the gate and an output terminal of the driving transistor through the turned-on first and third switches have levels for maintaining a turned-off state of the driving transistor.

5. The device according to claim 1, wherein the sensing circuit comprises an analog-digital converter which outputs a digital signal corresponding to the charged voltage.

6. A device for measuring an organic light emitting diode, comprising:

a first sensing line selectively connected with a first organic light emitting diode, and formed with a first parasitic capacitor;

a second sensing line selectively connected with a second organic light emitting diode, and formed with a second parasitic capacitor;

a compensation capacitor; and a switching circuit configured to sequentially connect the first sensing line and the second sensing line to the compensation capacitor;

a first current source configured to provide first constant current to the first sensing line to charge the first parasitic capacitor; and a second current source configured to provide second constant current to the second sensing line to charge the second parasitic capacitor, wherein deviation information is generated based on a first charge share voltage by connection of the first sensing line and the compensation capacitor and a second charge share voltage by connection of the second sensing line and the compensation capacitor, and wherein the deviation information corresponds to a deviation of the first constant current and the second constant current.

7. The device according to claim 6, wherein the first current source and the second current source are configured in correspondence to one driver, and wherein the driver drives the first organic light emitting diode and the second organic light emitting diode by receiving data compensated for in correspondence to the deviation information.

8. The device according to claim 6, wherein the first current source is configured in correspondence to a first driver, wherein the second current source is configured in correspondence to a second driver, and wherein the first driver and the second driver drive the first organic light emitting diode and the second organic light emitting diode by receiving respective data compensated for in correspondence to the deviation information.

9. The device according to claim 6, further comprising:

a first switch configured to selectively connect the first organic light emitting diode and the first sensing line;

a second switch configured to selectively connect the second organic light emitting diode and the second sensing line;

a first sensing circuit configured to sense a first charged voltage of the first parasitic capacitor; and a second sensing circuit configured to sense a second charged voltage of the second parasitic capacitor, wherein the first current source and the second current source charge the first parasitic capacitor and the second parasitic capacitor by supplying the first constant current and the second constant current to the first sensing line and the second sensing line, respectively, for a first period, in a state in which the first organic light emitting diode and the second organic light emitting diode are extinguished and the first switch and the second switch are turned on, and wherein, after the first period, the first sensing circuit and the second sensing circuit sense the first charged voltage and the second charged voltage of the first parasitic capacitor and the second parasitic capacitor.

* * * * *